US006803706B2

(12) United States Patent
Kurosawa et al.

(10) Patent No.: US 6,803,706 B2
(45) Date of Patent: Oct. 12, 2004

(54) LAMP WITH DOUBLE LAYER COILED-COIL FILAMENT

(75) Inventors: Akira Kurosawa, Miyagi-ken (JP); Masayoshi Hiratsuka, Miyagi-ken (JP)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/257,297

(22) PCT Filed: Mar. 4, 2002

(86) PCT No.: PCT/IB02/00676

§ 371 (c)(1),
(2), (4) Date: Oct. 10, 2002

(87) PCT Pub. No.: WO02/071444

PCT Pub. Date: Sep. 12, 2002

(65) Prior Publication Data

US 2003/0122464 A1 Jul. 3, 2003

(30) Foreign Application Priority Data

Mar. 6, 2001 (JP) ..... 01-62527

(51) Int. Cl.[7] ..... H01K 1/18
(52) U.S. Cl. ..... 313/271; 313/343; 313/272
(58) Field of Search ..... 313/271–273, 313/274, 578, 343, 279; 445/43

(56) References Cited

U.S. PATENT DOCUMENTS

| | | | | | |
|---|---|---|---|---|---|
| 2,126,155 | A | | 8/1938 | Van Dyck | 176/40 |
| 2,210,761 | A | * | 8/1940 | Hennelly | 313/343 |
| 3,717,783 | A | * | 2/1973 | Notelteirs et al. | 313/271 |
| 4,316,116 | A | | 2/1982 | Graves et al. | 313/344 |
| 4,499,401 | A | | 2/1985 | Graves et al. | 313/315 |
| 4,686,412 | A | | 8/1987 | Johnson, Jr. | 313/344 |
| 5,380,230 | A | * | 1/1995 | Smith et al. | 445/32 |

FOREIGN PATENT DOCUMENTS

| | | | |
|---|---|---|---|
| GB | 456760 | 11/1936 | |
| GB | 475006 | 11/1937 | |
| GB | 2065966 | 7/1981 | H01K/1/14 |

* cited by examiner

*Primary Examiner*—Joseph Williams

(57) ABSTRACT

The object of the invention is to provide an electric lamp with a coiled-coil filament, which is made more compact. An electric lamp 1 comprises a bulb 3 and a coiled-coil filament 2 accommodated in the bulb 3. According to the present invention, the coiled-coil filament 2 consists of a core filament 2' and an additional filament 2" which is wound around the core filament 2' and of which the diameter is smaller than the diameter of the core filament 2'.

3 Claims, 3 Drawing Sheets

LAMP WITH DOUBLE LAYER COILED-COIL FILAMENT

BACKGROUND OF THE INVENTION

1. Field of the Invention

The present invention relates to an incandescent type electric lamp, such as a halogen lamp, with a coiled-coil filament.

2. Description of Related Art

Incandescence electric lamps comprising the respective coiled-coil filaments are widely used in the field of small-sized lighting that requires high lighting intensities. In particular, it is known that the high efficiency of the light radiation effect can be obtained by using it with a reflector. Such an incandescence electric lamp may be used, for example, as a backlight to be equipped in a projector or the like or used as a heat source of rapid thermal processing (RTP) for a semiconductor device. Here, the coiled-coil filament means a filament prepared by coiling a filament material into a helical structure (primary-coiled) with a small diameter and further coiling it into a helical structure (secondary-coiled) with a large diameter.

FIG. 4 is a schematic view that illustrates an example of the conventional electric lamp having a vertically positioned coiled-coil filament. FIG. 5 is an enlarged view of a part of the coiled-coil filament 102 shown in FIG. 4. As shown in FIG. 4, an electric lamp 101 in this example comprises a tube-like bulb 103 made of quartz glass or the like. The bottom of the bulb 103 is provided as a pinch-seal portion 104 and the top of the bulb 103 is provided as an exhaust seal portion 105. In the bulb 103, one end of a coiled-coil filament 102 made of, for example, tungsten is electrically connected to one end of an inner lead 106 and the other end of the filament 102 is electrically connected to a molybdenum film 108 being embedded in the pinch-seal portion 104. The filament 102 is arranged so as to extend substantially in parallel with an axis line of the bulb 103. In the bulb 103, the lead 106 extends substantially in parallel with the axis line of the bulb 103 and the other end of the lead 106 is electrically connected to the molybdenum film 107 being embedded in the pinch-seal portion 104. Furthermore, the pinch-seal portion 104 is planted with a pair of outer leads 109 and 110 and these leads are connected to the lead 106 and the coiled-coil filament 102 through the molybdenum films 107 and 108, respectively.

SUMMARY OF THE INVENTION

In the case of using an electric lamp having a coiled-coil filament as a backlight for a projector or the like, such electric lamp is co-operated with an optical system. Thus, it is preferable that the filament may be small as much as possible. In other words, it is preferable that the filament may be close to a point source of light as much as possible. In addition, if it is used as a heat source of RTP (rapid thermal processing) for a semiconductor device, there is a requirement for reducing the size of an electric lamp to reduce the size of the semiconductor device. For such a size reduction, for example, there is an idea of further lessening the space between the secondary-coiled coils of the coiled-coil filament without changing the surface area of the filament. However, if the space between the secondary-coiled coils is too narrowed, a short circuit may occur. Thus, there is a limit to lessen said space Therefore, an object of the present invention is to provide an electric lamp having a coiled-coil filament with a further reduced size.

An electric lamp of the present invention for attaining the above object is one comprising a bulb and a coiled-coil filament accommodated in the bulb, characterized in that the coiled-coil filament consists of a core filament and an additional filament which is wound around the core filament and of which the diameter is smaller than the diameter of the core filament.

According to the present invention, a coiled-coil filament is formed as a double layer structure in which an additional filament with the diameter smaller than that of a core filament is wound around the core filament, so that the surface area of the coiled-coil filament per unit length can be increased, compared with the conventional filament having a diameter which is substantially equal to the sum of the diameter of the core filament and the diameter of the additional filament. Thus, the coiled-coil filament with a more reduced size can be obtained while the same initial characteristics as those of the conventional coiled-coil can be achieved. Consequently, the filament of the present invention can be closer to a point source of light, so that a higher efficient light emission can be achieved using the electric lamp of the present invention together with a reflecting mirror and an optical system, allowing not only the brighter electric lamp but also the size reduction of the electric lamp itself, compared with the conventional one. In addition, the electric lamp of the present invention improves the efficiency of light emission as mentioned above, so that electric power consumption can be reduced compared with the conventional one with respect to the same brightness, causing the economic effects thereof.

It is preferable that the core filament and the additional filament to be wound around the core filament may be made of the same material. Typically, tungsten is often used as a filament material. If tungsten is to be used as a material of the filament, both the core filament and the additional filament to be wound around the core filament may be preferably made of tungsten. According to the present invention, however, the filament material is not limited to tungsten and any material may be used.

The electric lamp of the present invention may be applied to a halogen lamp.

The coiled-coil filament in the electric lamp of the present invention may be arranged in the so-called vertical direction or arranged in the so-called horizontal direction.

DESCRIPTION OF THE PREFERRED EMBODIMENTS

Hereinafter, embodiments of the present invention will be discussed.

Figure 1:
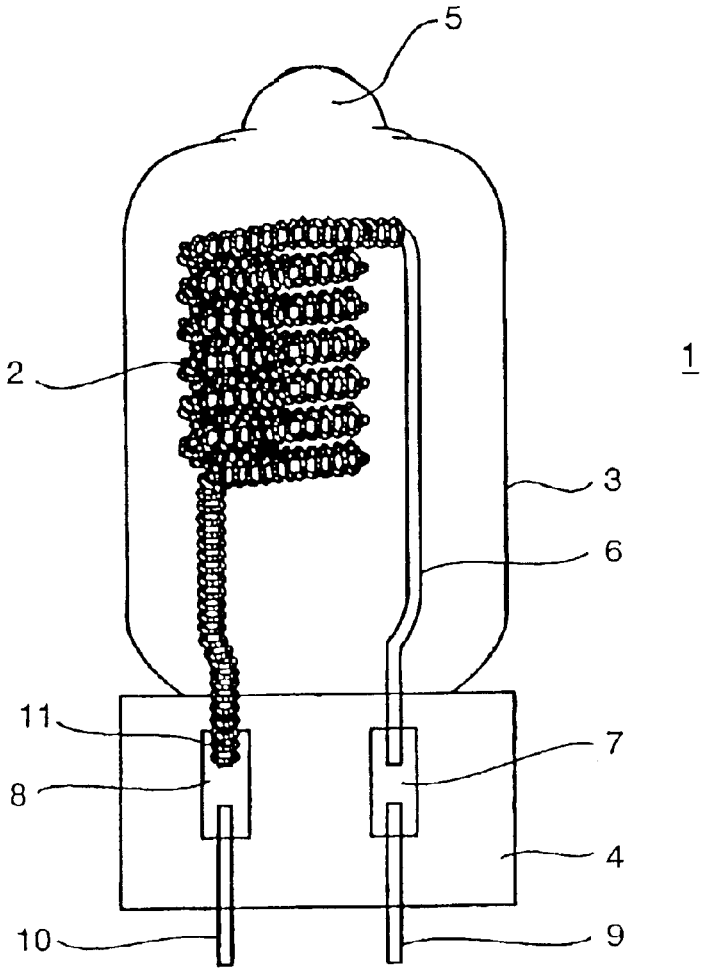
FIG. 1 is a schematic view that illustrates an embodiment of an electric lamp with a vertically-positioned coiled-coil filament in accordance with the present invention.
Figure 2:
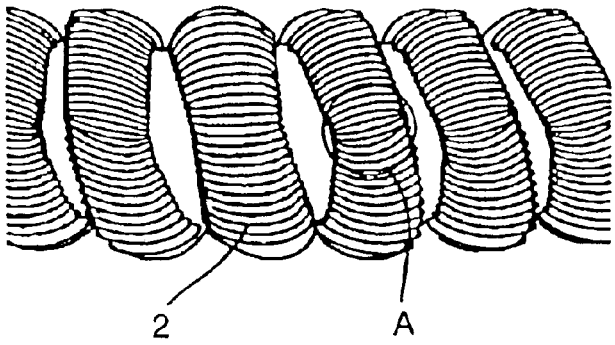
FIG. 2 is an enlarged view of a part of the coiled-coil filament shown in FIG. 1.
Figure 3:
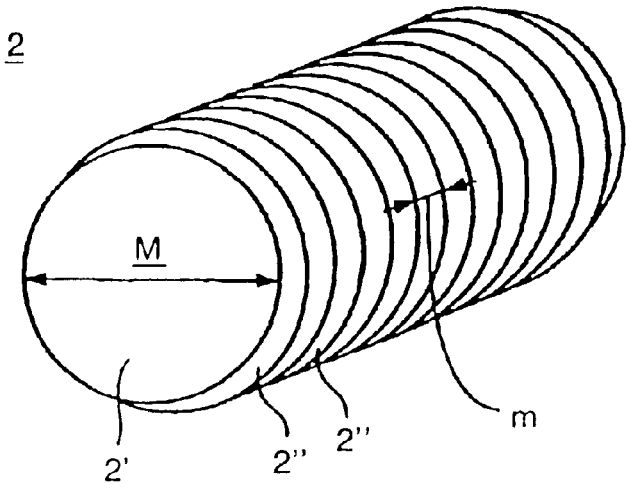
FIG. 3 is an enlarged perspective view of a part "A" of the coiled-coil filament shown in FIG. 2.

FIG. 1 is a schematic view that illustrates an embodiment of an electric lamp having a coiled-coil filament being arranged in the vertical direction. FIG. 2 is an enlarged view of a part of the coiled-coil filament 2 shown in FIG. 1. FIG. 3 is an enlarged perspective view of a part "A" of the coiled-coil filament 2 shown in FIG. 2.

Figure 4:
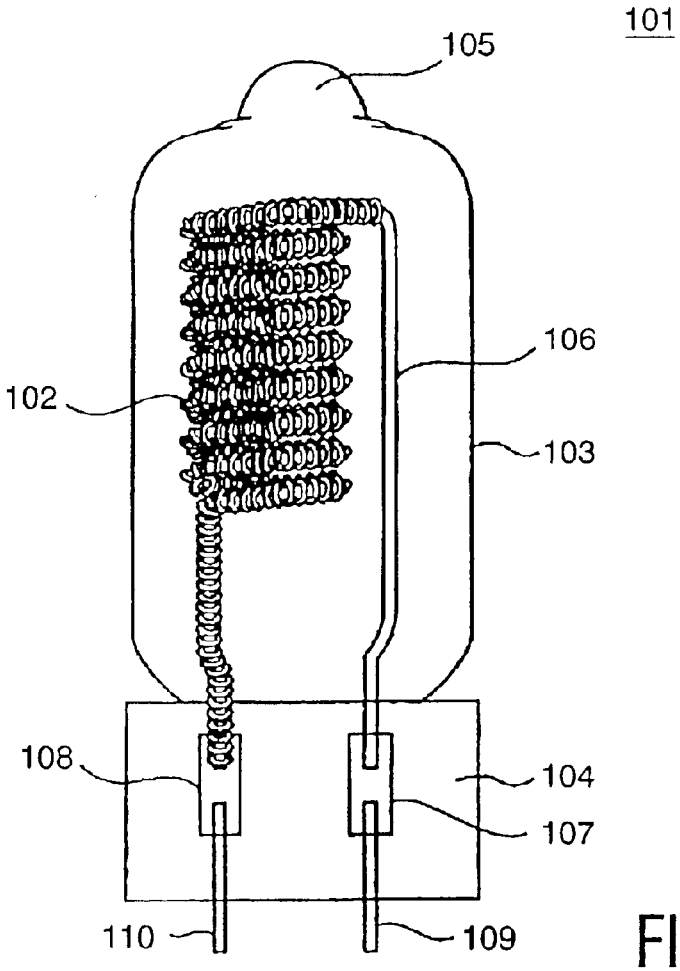
FIG. 4 is a schematic view that illustrates an example of a conventional electric lamp with a vertically-positioned coiled-coil filament.
Figure 5:
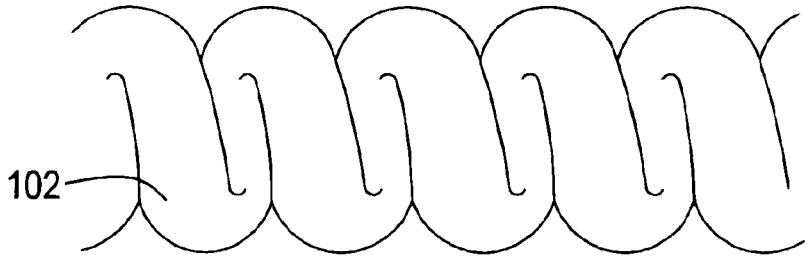
FIG. 5 is an enlarged view of a part of the coiled-coil filament shown in FIG. 4.

The electric lamp of the present invention shown in FIG. 1 and the conventional electric lamp shown in FIG. 4 are principally the same, except for their filament structures, bulb sizes, and so on.

As shown in FIG. 1, an electric lamp 1 in this embodiment comprises a tube-like bulb 3 made of quartz glass or the like. The bottom of the bulb 3 is provided as a pinch-seal portion 4 and the top of the bulb 3 is provided as an exhaust seal portion 5. In the bulb 3, one end of a coiled-coil filament 2 made of, for example, tungsten is electrically connected to one end of an inner lead 6 and the other end of the filament 2 is electrically connected to a molybdenum film 8 being embedded in the pinch-seal portion 4. The filament 2 is arranged so as to extend substantially in parallel with an axis line of the bulb 3. In the bulb 3, the lead 6 extends substantially in parallel with the axis line of the bulb 3 and the other end of the lead 6 is electrically connected to the molybdenum film 7 being embedded in the pinch-seal portion 4. Furthermore, the pinch-seal portion 4 is planted with a pair of outer leads 9 and 10 and these leads are connected to the lead 6 and the coiled-coil filament 2 through the molybdenum films 7 and 8, respectively. In order to prevent a coil portion of the coiled-coil filament 2 from being pressed and crushed when the filament 2 is welled onto the molybdenum film 8, an auxiliary lead 11 is inserted into a secondary coiled portion of the coiled-coil filament 2 to be welded on the molybdenum film 8.

As is evident from FIG. 3, according to the above embodiment, the coiled-coil filament 2 is provided as a double layer structure in which a fine filament 2" is tightly wound around a core filament 2'. Therefore, the surface area of the coiled-coil filament 2 per unit length can be increased, compared with the conventional filament having a diameter substantially equal to the sum of the diameter "M" of the filament 2' and the diameter "m" of the filament 2". As a result, the size of the coiled-coil filament with the double layer structure according to the present invention can be reduced while the same initial characteristics as those of the conventional coiled-coil filament can be achieved.

The electric lamp of the present invention can be manufactured as follows. First of all, a fine filament is would around a core filament using a coiling apparatus while adjusting the winding rate. Subsequently, for preventing the spring back of the above fine filament, an annealing process is performed. Subsequently, the filament having thus double layer structure subjected to such annealing process is further subjected to primary- and secondary-coiling processes. The process of preparing the coiled-coil filament by such primary and secondary coiling processes can be the same as that of preparing the conventional coiled-coil filament, so that the explanation thereof may be omitted here.

In the concrete example of the present invention, tungsten wires were used as a core filament and a fine filament to be wound around the core filament, respectively. The diameter of the core tungsten wire was 0.2 $\mu$m and the fine tungsten wire to be wound around the core tungsten wire was 0.02 $\mu$m. An electric lamp having such a coiled-coil filament of the present invention was compared with the conventional electric lamp having a coiled-coil filament using a tungsten wire of 0.22 $\mu$m in diameter as a filament, with respect to their characteristic features. Regarding the pitch between the primary-coiled coils and the pitch between the secondary-coiled coils, the electric lamp of the present invention was substantially the same as the conventional electric lamp. As a result, the electric lamp of the present invention comprising the coiled-coil filament with a size corresponding to approximately 75 percent of the size of the conventional coiled-coil filament attained the same initial characteristics as those of the conventional one.

Although in the above embodiment, tungsten is used as a filament material, according to the present invention, it is not limited to tungsten but also any material may be used as a filament material. Preferably, however, both filament materials as a core filament and a fine filament to be wound around the core filament may be made of the same material. For instance, if carbon is used as a material of filament, both the core filament and the fine filament to be wound around the core filament may be preferably made of carbon.

The configuration of the electric lamp according to the present invention is not only limited to be applied on a vertically-positioned coiled-coil filament but also it can be applied on the horizontally-positioned coiled-coil filament.

Figure 6:
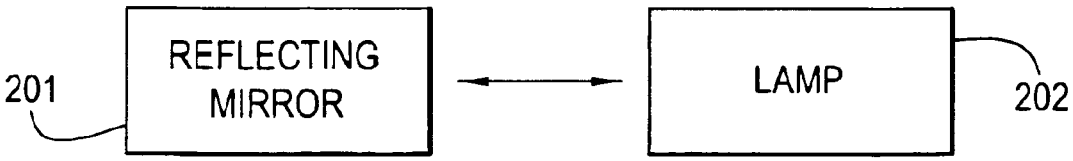
FIG. 6 is a schematic representation of a lamp and reflector.

As explained above, according to the present invention, a coiled-coil filament is constructed as a double layer structure in which an additional filament having a diameter smaller than that of a core filament is wound around the core filament. As a result, the surface area of the coiled-coil filament per unit length can be more increased, compared with the conventional filament having a diameter substantially equal to the sum of the diameter of the core filament and the diameter of the additional filament. Thus, the coiled-coil filament having a reduced size allows the same initial characteristics as those of the conventional coiled-coil filament. Consequently, the filament of the present invention can be further close to a point source of light, so that a higher efficient light emission can be achieved using the electric lamp of the present invention together with a reflecting mirror and an optical system, as shown in FIG. 6 which depicts reflecting mirror 201 and lamp 202 in schematic form, allowing not only the brighter electric lamp but also the size reduction of the electric lamp itself, compared with the conventional one. In addition, the electric lamp of the present invention improves the efficiency of light emission as mentioned above, so that electric power consumption can be reduced compared with the conventional one with respect to the same brightness, causing the economic effects thereof.

What is claimed is:

1. An optical system comprising:

an incandescent lamp comprising a bulb and a coiled-coil filament which is capable of emitting light accommodated in the bulb, wherein the coiled-coil filament consists of a core filament and an additional filament which is tightly wound around the core filament and of which the diameter is smaller than the diameter of the core filament, and a reflector for reflecting radiation emitted by said lamp.

2. An optical system as claimed in claim 1, characterized in that the core filament and the additional filament are made of tungsten.

3. An optical system as claimed in claim 1, characterized in that the inner space of the bulb is filled with halogen.

* * * * *